United States Patent [19]

Takami et al.

[11] Patent Number: 4,784,501

[45] Date of Patent: Nov. 15, 1988

[54] METHOD OF ENHANCING FINE LINE OF PRINTER AND RELATED CIRCUIT

[75] Inventors: Masato Takami; Akio Akao, both of Hirakata, Japan

[73] Assignee: Sanyo Electric Co., Ltd., Japan

[21] Appl. No.: 51,729

[22] Filed: May 18, 1987

[30] Foreign Application Priority Data

May 20, 1986 [JP] Japan ..... 61-117100

[51] Int. Cl.[4] ..... B41J 3/12; B41J 3/20

[52] U.S. Cl. ..... 400/120; 400/121; 101/93.04; 346/76 PH

[58] Field of Search ..... 400/120, 121, 210, 304; 101/93.04, 93.05; 340/728; 346/76 PH

[56] References Cited

U.S. PATENT DOCUMENTS

| | | | |
|---|---|---|---|
| 4,347,518 | 8/1982 | Williams | 400/120 X |
| 4,532,503 | 7/1985 | Pennebaker | 340/728 |
| 4,574,293 | 3/1986 | Inui | 400/120 X |
| 4,683,479 | 7/1987 | Horiya | 400/120 X |

FOREIGN PATENT DOCUMENTS

| | | | |
|---|---|---|---|
| 40570 | 4/1981 | Japan | 400/120 |
| 2775 | 1/1982 | Japan | 400/120 |
| 71168 | 4/1983 | Japan | 400/304 |
| 230854 | 11/1985 | Japan | 400/210 |

OTHER PUBLICATIONS

*IMB Tech. Disc. Bulletin,* H. E. Berkebile, vol. 25, No. 10, Mar. 1983, 400–121 (2 pages) "Draft to Text Font Conversion Algorithum".

*Primary Examiner*—Paul T. Sewell

*Attorney, Agent, or Firm*—Darby & Darby

[57] ABSTRACT

The present invention relates to a method and a circuit for enhancing a fine line in the direction perpendicular to the arraying direction of the printing elements (i.e., in the direction of moving the printing paper) of a line printer which prints by applying either thermal elements or wires giving dot impact, and in which, for example, supposing the successive 4 printing elements comprising A, B, C and D, when the printing element C prints black and all others do white, the printing element C prints black and the other print while, the printing element B is made to print black to enhance a fine line by printing with two printing elements, so that the total visibility of the fine line is improved.

15 Claims, 7 Drawing Sheets

| ORIGINAL DATA D C B A | ENHANCED DATA B′ |
|---|---|
| 0 0 0 0 | 0 |
| 0 0 0 1 | 0 |
| 0 0 1 0 | 1 |
| 0 0 1 1 | 1 |
| 0 1 0 0 | 1 |
| 0 1 0 1 | 0 |
| 0 1 1 0 | 1 |
| 0 1 1 1 | 1 |
| 1 0 0 0 | 0 |
| 1 0 0 1 | 0 |
| 1 0 1 0 | 1 |
| 1 0 1 1 | 1 |
| 1 1 0 0 | 0 |
| 1 1 0 1 | 0 |
| 1 1 1 0 | 1 |
| 1 1 1 1 | 1 |

Fig. 6

ORIGINAL DATA

| n-1 | | n | | | | | | | | n+1 |
|---|---|---|---|---|---|---|---|---|---|---|
| $A_{10}$ | $A_9$ | $A_8$ | $A_7$ | $A_6$ | $A_5$ | $A_4$ | $A_3$ | $A_2$ | $A_1$ | $A_0$ |
| MDB 1 | MDB 0 | MDA 7 | MDA 6 | MDA 5 | MDA 4 | MDA 3 | MDA 2 | MDA 1 | MDA 0 | MD 7 |
| 0 | 0 | 0 | 0 | 0 | 0 | 0 | 0 | 0 | 0 | 0 |
| 0 | 0 | 0 | 0 | 0 | 0 | 0 | 0 | 0 | 0 | 1 |
| 0 | 0 | 0 | 0 | 0 | 0 | 0 | 0 | 0 | 1 | 0 |
| 0 | 0 | 0 | 0 | 0 | 0 | 0 | 0 | 0 | 1 | 1 |
| 0 | 0 | 0 | 0 | 0 | 0 | 0 | 0 | 1 | 0 | 0 |
| 0 | 0 | 0 | 0 | 0 | 0 | 0 | 0 | 1 | 0 | 1 |
| 0 | 0 | 0 | 0 | 0 | 0 | 0 | 0 | 1 | 1 | 0 |
| | | | | | ⋮ | | | | | |
| 1 | 1 | 1 | 1 | 1 | 1 | 1 | 1 | 1 | 0 | 1 |
| 1 | 1 | 1 | 1 | 1 | 1 | 1 | 1 | 1 | 1 | 0 |
| 1 | 1 | 1 | 1 | 1 | 1 | 1 | 1 | 1 | 1 | 1 |

→

ENHANCED DATA

| n | | | | | | | |
|---|---|---|---|---|---|---|---|
| $D_7$ | $D_6$ | $D_5$ | $D_4$ | $D_3$ | $D_2$ | $D_1$ | $D_0$ |
| AD 7 | AD 6 | AD 5 | AD 4 | AD 3 | AD 2 | AD 1 | AD 0 |
| 0 | 0 | 0 | 0 | 0 | 0 | 0 | 0 |
| 0 | 0 | 0 | 0 | 0 | 0 | 0 | 0 |
| 0 | 0 | 0 | 0 | 0 | 0 | 0 | 1 |
| 0 | 0 | 0 | 0 | 0 | 0 | 0 | 1 |
| 0 | 0 | 0 | 0 | 0 | 0 | 1 | 1 |
| 0 | 0 | 0 | 0 | 0 | 0 | 1 | 0 |
| 0 | 0 | 0 | 0 | 0 | 0 | 1 | 1 |
| | | | ⋮ | | | | |
| 1 | 1 | 1 | 1 | 1 | 1 | 1 | 0 |
| 1 | 1 | 1 | 1 | 1 | 1 | 1 | 1 |
| 1 | 1 | 1 | 1 | 1 | 1 | 1 | 1 |

METHOD OF ENHANCING FINE LINE OF PRINTER AND RELATED CIRCUIT

BACKGROUND OF THE INVENTION

1. Field of the Invention

The present invention relates to a printer generally called "line printer" such as a thermal line printer or a wire-dot printer, or the like, more particularly, to a method for enhancing a fine line in the longitudinal direction of the printer, i.e., in the direction perpendicular to the printing line, and a circuit therefor.

2. Description of the Prior Art

Today, apparatus generally called a "line printer" is extensively available. This apparatus typically incorporates linearly arraying printing elements such as thermal elements or wires for providing dot impact for executing printing operation by making a printing medium (i.e., printing paper) able to drive itself in a direction perpendicular to the arraying direction of the printing elements. These line printers process image data given as black/white dot data or stored in memory in the form of binary encoded signals "1" or "0". The line printer then supplies those binary encoded signals to respective printing elements before eventually printing the original image data using these printing elements which are set either in the printing-activated or the printing-inactive state.

However, the line printers of the type mentioned above still have a problem to be solved. For example, when applying a recording density of more than 12-dot/mm of high resolution, width of longitudinal line (in the direction perpendicular to the arraying direction of the printing elements) by one printing element becomes significantly finer than the later line (in the arraying direction of the printing elements). In particular, this symptom is quite significant when an image is printed on a transparent film like the one used for overhead projectors, for example.

Furthermore, in applying thermal elements, due to restrictive conditions caused by wiring circuits, any one of these line printers needs to have the design of the heating element in a long and slender configuration in the direction perpendicular to the arraying direction of the printing element. As a result, when operating a thermal printer using thermal elements, fine lines in the longitudinal direction become extremely fine, thus causing poor visibility.

To solve these problems mentioned above, the inventors of this invention searched prior arts, so that Japanese Patent Laid-Open No. 56-40570 (1981) and another Japanese Patent Laid-Open No. 57-2775 (1982) for example were found. However, both of these prior art references merely make up identical picture elements with a plurality of thermal elements for making respective picture elements of a thermal printer to totally express themselves for printing identical picture elements with a plurality of thermal elements. As a result, the inventors could not confirm concrete means for fully solving those problems mentioned above.

SUMMARY OF THE INVENTION

The primary object of the invention is to overcome those problems mentioned above by providing a novel method for enhancing a fine line of a printer and a circuit capable of securely improving visibility of a fine line in the direction perpendicular to the arraying direction of the elements by enhancing the printed fine line with two printing elements by means of activated printing elements on one side when those printing elements in positions adjoining both-sides of printing elements in a printing-activated state are inactive.

The second object of the invention is to provide a novel method for enhancing a fine line of a printer and a circuit capable of securely preventing specific portions which should originally be expressed in the white line by one element from being expressed in black by activated printing elements on one-side into a printing-activated state only when those printing elements in positions adjoining both sides of those printing elements in the printing-activated state and those printing elements farther than these one-side printing elements respectively are inactive.

The third object of the invention is to provide a novel method for enhancing a fine line of printing elements and a circuit capable of dispensing with fine line enhancing operation against data for example by optional selection modes for either executing or deleting enhancement of fine lines.

The fourth object of the invention is to provide a novel fine line enhancing circuit for a printer, which is capable of executing the fine line enhancing operations at an extremely fast speed by creating circuits by employing hardware without the need for software.

This invention is a method for enhancing a fine line in the direction perpendicular to the arraying direction of the printing elements of a printer, in which said printer prints by making a plurality of linearly-arrayed printing elements selectively driven while relatively moving said printing elements and printing medium in the direction perpendicular to the arraying direction of said printing elements comprising steps of; checking whether each of said plurality of printing elements is in an active state or not; checking whether printing elements in the positions adjoining both sides of each active printing element are in the active state or not; and making either of two printing elements adjoining both sides of said active printing elements in the active state only when said two printing elements adjoining both sides of said active printing elements are inactive.

The invention will be better understood from the detailed description given hereinbelow and the accompanying drawings which are given by way of illustration only, and thus are not intended to limit the invention and wherein:

BRIEF DESCRIPTION OF THE DRAWING

FIG. 6 is a data-conversion table used therefor;

DESCRIPTION OF THE PREFERRED EMBODIMENT

Referring now more particularly to the accompanying drawings, one of the preferred embodiments of the invention is described below.

Figure 1:
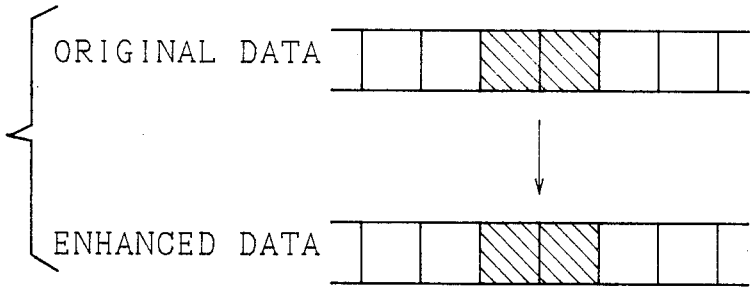
FIGS. 1*a*, 1*b* and 1*c* are schematic diagrams denoting the original data and the enhanced data generated by processing the original data, which are respectively presented for explaining the fine line enhancing process of the invention.
Figure 1:
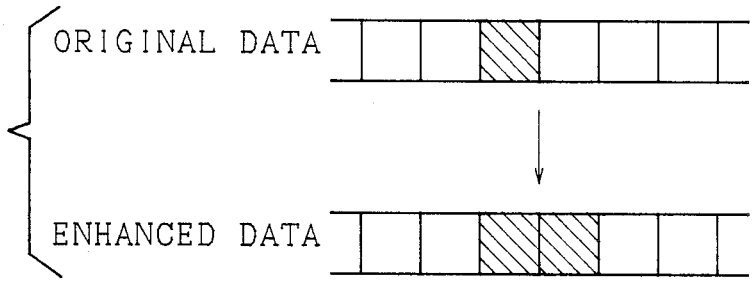
Figure 1:
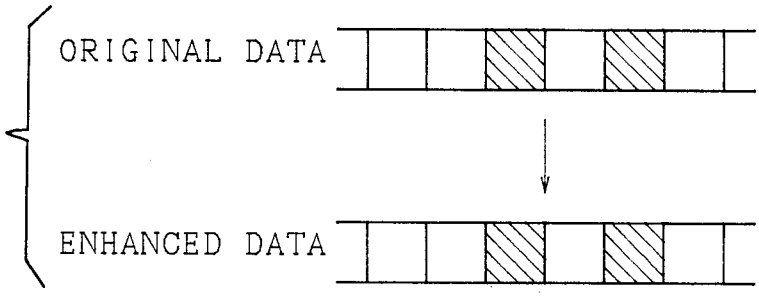

FIG. 1 (*a*) through (*c*) respectively explain the principles of the invention, in which each segment represents data corresponding to 1-dot of the original image to be printed by each printing element. Hatched data denotes black (corresponding to "1" of the binary encoded data), whereas unhatched data denotes white (corresponding to "0" of the same), respectively. Note that those data prior to the execution of the enhancing operation and those data after execution of the enhancing operation are respectively called "original data" and "enhanced data" in the following description.

Figures 2, 3:
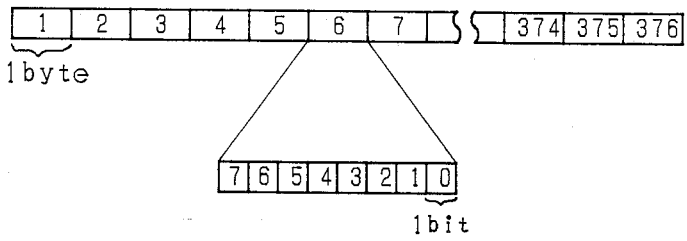
FIG. 2 is a schematic diagram denoting the image data processed by the invention.
FIG. 3 is a chart denoting the basic content of a basic data-conversion table of the fine line enhancing process.

Arraying of data printed by the line printer is explained by referring to the schematic diagram shown in FIG. 2. The preferred embodiment of the invention does not process those data denoted by character pattern (font data), but only processes with raster data indicating image by dots. In this embodiment, each line is provided with 376 bytes (3008 bits) of data which are sequentially processed from the upper 8th bit shown to the left of the lowest byte (the first byte).

Referring now to FIG. 1, the principle of the fine line enhancing operation of the invention is described below. Basically, as shown in FIG. 1(*b*), this invention processes the bit "1" having "0" on both sides for executing fine line enhancing operation. However, as shown in FIG. 1 (*c*), despite the presence of "0" on both sides, if binary code data "1" positions in the adjoining the lower-bit side, no enhancing operation is executed in order to prevent data which should be expressed as white fine lines from being shaded in black. If binary code data "1" is present in either of the sides as shown in FIG. 1 (*a*), no enhancing operation is executed. Data which is newly turned into binary code data "1" (black) by the enhancing operation become data adjoining the lower bit side of the data designated for the enhancing operation.

Figure 4:
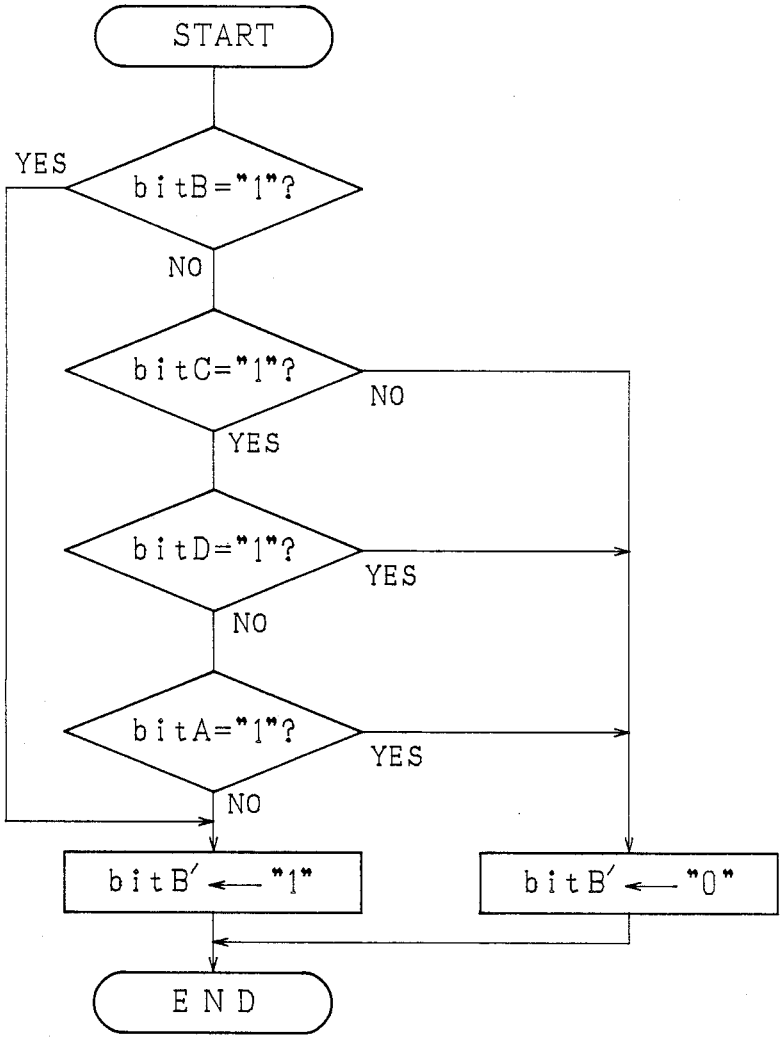
FIG. 4 is an operational flowchart denoting the content of the logical operation of the fine line enhancing process.

Accordingly, in order to apply enhancing operation to each bit of data, this invention needs four successive bits of the original data including the objective bit for enhancement. Four bits A through D arrayed in the inverse order as shown in FIG. 3 generate the state of bit B′ after the enhancing operation. Specifically, when considering optional bits of the original data, value of the enhanced bit B′ is determined by four bits including bit B itself, the upper two bits B and C, and lower bit A (the relationship between the upper and lower bits may be reversed). Consequently, execution of the logic operation shown in the flowchart of FIG. 4 yields the result shown in FIG. 3.

More particularly, if bit B is "1", the enhanced bit B, i.e., bit B′ becomes "1". Conversely, if bit B is "0", adjoining bit C being "0", bit D being "1", and bit A being "1", then bit B′ becomes "0". In other words, when considering bit C as the basis, bit B bearing "0" can be inverted into "1" only when bit C itself is "1" against bits A, B, and D bearing "0". Consequently, when the above condition is present, two successive bits C and B are inverted into "1" (black) to achieve the aimed enhancement.

Normally, any conventional line printer executes data processing operation by applying microprocessor as control means. This also makes it necessary for the fine line enhancing method and associated circuit of the invention to execute data processing operation on the basis by byte (1 byte corresponds to 8 bits) unit.

Figure 5:
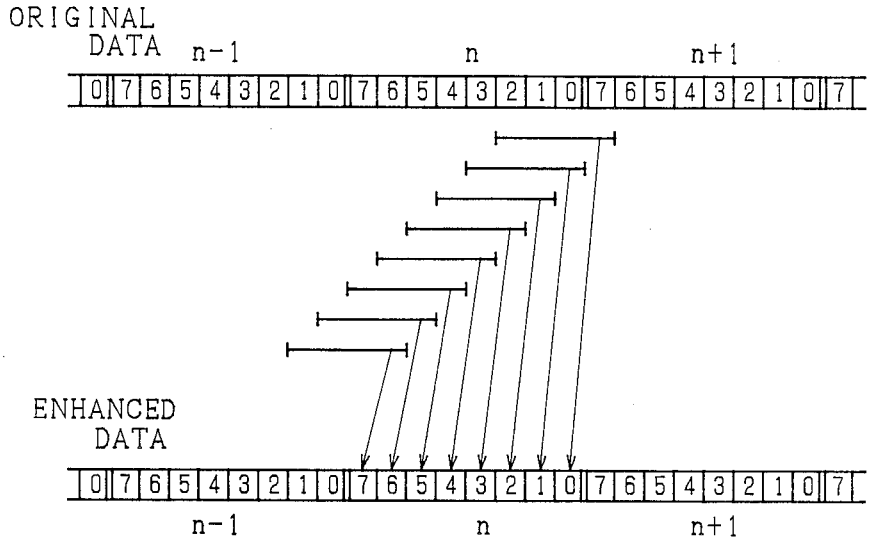
FIG. 5 is a schematic diagram denoting the relationship between the original data and the enhanced data when the fine line enhancing operation is executed on a one-byte basis using a concrete circuit.

FIGS. 5 and 6 are respectively the charts for explaining the fine line enhancing operation executed on the basis by 1 byte. As is clear from the foregoing description and FIG. 5, in order to gain 1 byte, i.e., 8-bit enhanced data, a total of 11 bits of the original data are needed, which include 8-bit data, 1-bit data in the lower position of the least significant bit of the enhanced data, and 2-bit data in the upper position of the most significant bit of the enhanced data, respectively. FIG. 6 is the logic table needed for converting the actual original data into the enhanced data.

Accordingly, conversion of the successive 11-bit original data based on the conversion table shown in FIG. 6 generates 8-bit, i.e., 1 byte enhanced data. Although this conversion can be also done using software, since the conversion table is preliminarily stored in memory as data. The preferred embodiment of the invention allows use of either ROM or RAM which outputs 8-bit date in accordance with the conversion logic mentioned above in response to the 11-bit address input.

Needless to say that those operations of the logic conversion and output of data from ROM or RAM can be also executed on the basis of 16 bits in addition to the above-cited 8-bit (1 byte) basis.

Next, constitution and functional operation of the fine line enhancing circuit executing the fine line enhancing operation of the invention are described below.

Figure 7:
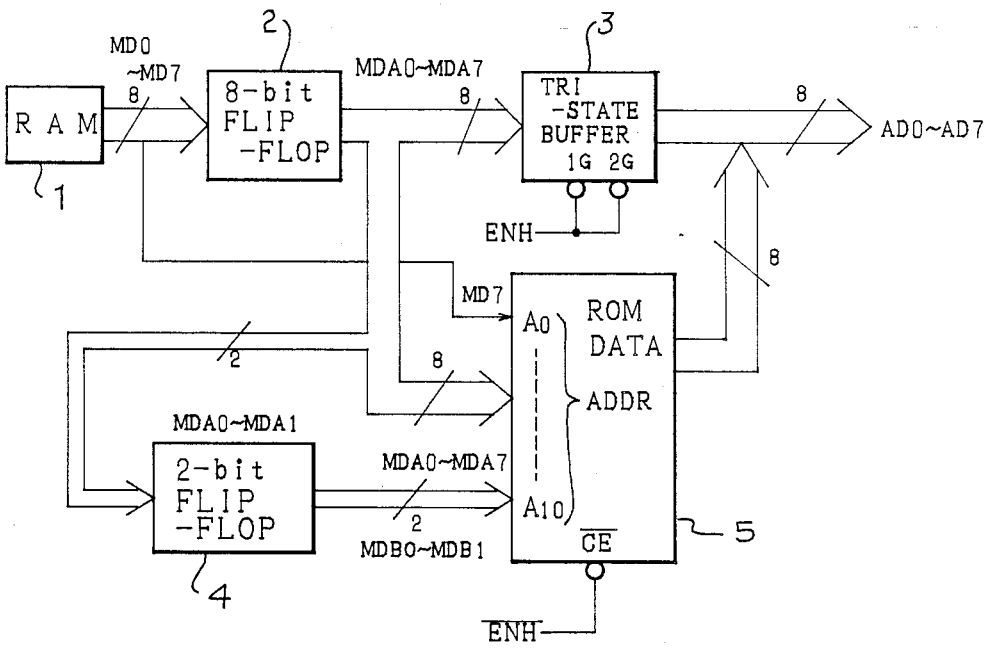
FIG. 7 is a block diagram of the fine line enhancing circuit of the invention.
Figure 8:
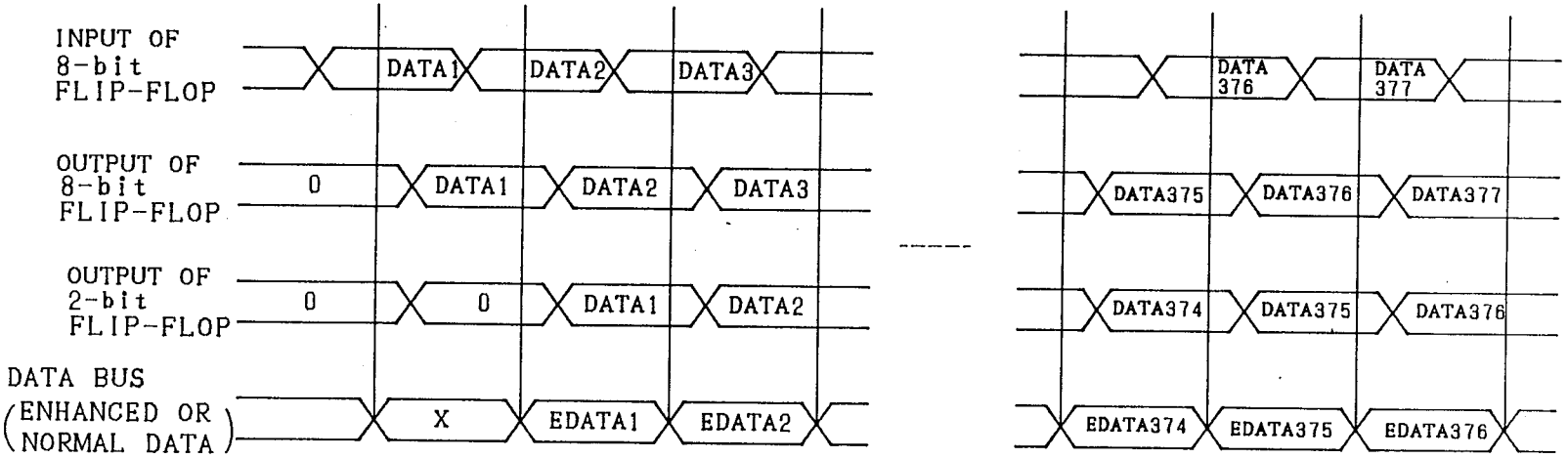
FIG. 8 is a timing chart presented for explaining the operations thereof.

FIG. 7 is the simplified block diagram of one of the preferred embodiments of the fine line enhancing circuit of the invention and FIG. 8 is the timing chart for explaining the operation thereof. The following embodiment introduce the circuit constitution for processing data using hardware. However, it is also possible for the embodiment to introduce data processing means using software as mentioned above.

The fine line enhancing circuit of the invention incorporates the following: RAM 1 (image memory) which stores image data as dot data and executes input and output of image data by 8-bit: 8-bit flip flop 2 operating as an 8-bit delay circuit: tri-state buffer 3 operating as gate circuit which directly outputs data from RAM 1 to a data bus by activating itself while the enhance signal $\overline{ENH}$ is set in low level: 2-bit flip flop 4 operating itself as a 2-bit delay circuit: ROM 5 which stores the conversion table shown in FIG. 6 for converting 11-bit original data into 8-bit enhanced data and operates itself as a conversion circuit by activating itself while the enhance signal $\overline{ENH}$ is set in low level: and the data bus for transferring data.

When the enhancing operation is executed, in other words, when raster data being the object of processing is outputted from the RAM 1, the enhance signal $\overline{ENH}$ is set to low level. This inactivates the tri-state buffer 3 and simultaneously activates the ROM 5.

The RAM 1 successively outputs image data by 8-bit (1-byte) unit, i.e., by 8 bits per operating cycle. The 8-bit image data MD0 through MD7 are supplied to the 8-bit flip flop 2, while the most significant bit MD7 is supplied to the ROM 5 as the least significant address A0 thereof.

After provisionally latching the received 8-bit image data MD0 through MD7, the 8-bit flip flop 2 makes these data to delay themselves by one cycle, i.e., for a period until 1-byte data is output from the RAM 1, and then, when the next 8-bit image data MD0 through MD7 is received, the 8-bit flip flop 2 supplies the 8-bit data MD0 through MD7 as 8-bit output MDA0 through MDA7 to the tristate buffer 3 and the ROM 5 for making up address A1 being the second to the least significant address and address A8 being the third from the most significant address.

Of the 8-bit image data MDA0 through MDA7 outputted from the 8-bit flip flop 2, the lower 2-bit MDA0 and MDA1 are supplied to the 2-bit flip flop 4. After provisionally latching these data, the 2-bit flip flop 4 makes these data to delay themselves for one cycle, and then, when 2-bit image data MDA0 and MDA1 of the following byte is received, the 2-bit flip flop 4 supplies the 2-bit data MDA0, MDA1 as 2-bit output MDB0 and MDB1 to ROM 5 as the most significant addresses A9 and A10.

When the present original data is the n-th byte, 8-bit image data MDA7 through MDA0 of the n-th byte are supplied to addresses A1 through A8 of the ROM5, whereas the most significant bit MD7 of the (n+1)th byte is supplied to the address A0 of the ROM5, and the least significant side 2-bit output data MDB0 and MDB1 of the (n−1)th byte are supplied to addresses A9 and A10 of the ROM5, respectively.

As a result, the ROM 5 makes 11-bit signals MDB1, MDB0, MDA7 through MDA0, and MD7 address signal ADDR, and outputs stored data corresponding to the address signal, that is to say the data according to the conversion table shown in FIG. 6 as the 8-bit enhanced data to the data bus.

When no enhancing process is applied to image data like font data for example, enhance signal $\overline{ENH}$ is set to high level to inactivate the ROM 5 so that no enhancing process can be done. This makes signal ENH low level to activate the tristate buffer 3, thus making the 8-bit image data MD0 through MD7 from the RAM 1 be directly output to the data bus via the 8-bit flip flop 2 and the tristate buffer 3, respectively. When these operations are underway, no enhancing process is executed.

As is clear from the above description, according to the invention, when executing printing operations using printing elements such as thermal elements or wire dots, fine line in the longitudinal direction to be originally printed by only one printing element is printed by two printing elements for enhancing the printed effect, thus significantly improving visibility.

As the present invention may be embodied in several forms without departing from the spirit of essential characteristics thereof, the present embodiment is, therefore, illustrative and not restrictive, since the scope of the invention is defined by the appended claims rather than by the description preceding them, and all changes that fall within metes and bounds thereof are, therefore, intended to be embraced by the claims.

What is claimed is:

1. A method for enhancing a fine line in a direction perpendicular to an arraying direction of the printing elements of a printer, in which said printer prints by making a plurality of linearly-arrayed printing elements selectively drive while relatively moving said printing elements and printing medium in the direction perpendicular to the arraying direction of said printing elements comprising the following steps of;

checking whether each of said plurality of printing elements is in the active state or not;

checking whether printing elements in the positions adjoining both sides of each active printing element are in the active state or not; and causing either of two printing elements adjoining both sides of said active printing elements to be in the active state only when said two printing elements adjoining both sides of said active printing elements are inactive.

2. A method for enhancing a fine line as set forth in claim 1, in which said printing elements are thermal elements.

3. A method for enhancing a fine line as set forth in claim 1, in which said printing elements are wires giving dot impact.

4. A method for enhancing a fine line in a direction perpendicular to an arraying direction of the printing elements of a printer, in which said printer prints by making a plurality of linearly-arrayed printing elements selectively drive while relatively moving said printing elements and printing medium in a direction perpendicular to the arraying direction of said printing elements comprising the following steps of;

checking whether each of said plurality of printing elements is in the active state or not;

checking whether a printing element adjoining one-side of active printing element, a printing element adjoining the other side of said active printing element, and a printing element adjoining a side farther than said other side are in the active state or not; and causing the printing element adjoining the other side of the active printing element to be in the active state only when all the three adjoining printing elements are inactive.

5. A method for enhancing a fine line as set forth in claim 4, in which said printing elements are thermal elements.

6. A method for enhancing a fine line as set forth in claim 4, in which said printing elements are wires giving dot impact.

7. A method for enhancing a fine line as set forth in claim 4, in which said one side is the previous side in the order of signals for activating operations of said plurality of printing elements.

8. A fine line enhancing circuit of a printer executing printing operations using a plurality of linearly-arrayed printing elements which are caused to be in the active state on receiving of a binary encoded signal "1" and the inactive state on receiving of a binary encoded signal "0", in which said printer selectively supplies said binary encoded signal "1" or "0" to each printing element by relatively moving the printing medium and said printing elements in a direction perpendicular to the arraying direction of said printing elements, comprising;

an image memory which outputs m-bit binary encoded signal to be supplied to said printing elements by single operation;

an m-bit delay circuit making the output from said image memory delay by one-operation period;

a 2-bit delay circuit making the lower 2-bit data from said m-bit delay circuit delay by one-operation period;

a signal conversion circuit which receives the upper 1-bit from said image memory, m-bit from said m-bit delay circuit, and 2-bit from said 2-bit delay circuit as the input signals, and then, converts the received m+3 bit binary encoded signal in accordance with data-conversion logic converting the (n+1)th binary encoded signal into "1" when the n-th binary encoded signal is "1", the (n+1)th, the (n+2)th, and the (n−1)th binary encoded signals are respectively "0", into the serial m-bit binary encoded signal before externally outputting it.

9. A fine line enhancing circuit as set forth in claim 8, in which said printing elements are thermal elements.

10. A fine line enhancing circuit as set forth in claim 8, in which said printing elements are wires giving dot impact.

11. A fine line enhancing circuit as set forth in claim 8, in which said signal conversion circuit is a memory means receiving said m+3 bit signals as the address signals and outputs m-bit binary encoded signals in accordance with said conversion logic.

12. A fine line enhancing circuit of a printer executing printing operations using a plurality of linearly-arrayed printing elements which are caused to be in the active state on receiving of a binary encoded signal "1" and the inactive state on receiving of a binary encoded signal "0", in which said printer selectively supplies said binary encoded signal "1" or "0" to each printing element by relatively moving the printing medium and said printing elements in the direction perpendicular to the arraying direction of said printing elements, comprising;

an image memory which outputs m-bit binary encoded signal to be supplied to said printing elements by single operation;

an m-bit delay circuit making the output from said image memory delay by one-operation period;

a 2-bit delay circuit making the lower 2-bit data from said m-bit delay circuit delay by one-operation period;

a signal conversion circuit which receives the upper 1-bit from said image memory, m-bit from said m-bit delay circuit, and 2-bit from said 2-bit delay circuit as the input signals, and then, converts the received m+3 bit binary encoded signal in accordance with date-conversion logic converting the (n+1)th binary encoded signal into "1" when the n-th binary encoded signal is "1", the (n+1)th, the (n+2)th, and the (n−1)th binary encoded signals are respectively "0", into the serial m-bit binary encoded signal before externally outputting it; and a switching circuit for supplying the binary encoded signal outputted from said image memory directly to said printing elements or to said signal conversion circuit.

13. A fine line enhancing circuit as set forth in claim 12, in which said printing elements are thermal elements.

14. A fine line enhancing circuit as set forth in claim 12, in which said printing elements are wires giving dot impact.

15. The fine line enhancing circuit as set forth in claim 12, in which said signal conversion circuit is a memory means receiving said m+3 bit signal as the address signal and outputs m-bit binary encoded signals in accordance with said conversion logic.

* * * * *